US008108962B2

(12) United States Patent
Davidson et al.

(10) Patent No.: US 8,108,962 B2
(45) Date of Patent: Feb. 7, 2012

(54) TOOTHBRUSH AND METHOD OF USING THE SAME

(76) Inventors: Michael Davidson, Houston, TX (US); Michael Smith, Friendswood, TX (US)

( * ) Notice: Subject to any disclaimer, the term of this patent is extended or adjusted under 35 U.S.C. 154(b) by 706 days.

(21) Appl. No.: 12/220,286

(22) Filed: Jul. 23, 2008

(65) Prior Publication Data

US 2009/0044360 A1 Feb. 19, 2009

Related U.S. Application Data

(60) Provisional application No. 60/961,572, filed on Jul. 23, 2007.

(51) Int. Cl.
*A46B 11/02* (2006.01)

(52) U.S. Cl. ..... 15/167.1; 15/143.1; 15/22.1

(58) Field of Classification Search ..... 15/22.1, 15/167.1, 143, 22.2, 201, 207.2
See application file for complete search history.

(56) References Cited

U.S. PATENT DOCUMENTS 4,847,936 A * 7/1989 Moglianesi et al. ..... 15/167.1
5,072,477 A * 12/1991 Pai ..... 15/22.1
5,546,626 A * 8/1996 Chung ..... 15/167.1
5,749,381 A 5/1998 Butler et al.
6,030,215 A * 2/2000 Ellion et al. ..... 433/89
6,202,241 B1 * 3/2001 Hassell et al. ..... 15/22.1
6,332,233 B1 * 12/2001 Proulx ..... 15/167.1
6,735,804 B2 * 5/2004 Carlucci et al. ..... 15/28
6,766,824 B2 * 7/2004 Taylor ..... 137/522
6,957,468 B2 * 10/2005 Driesen et al. ..... 15/167.1
7,159,950 B2 * 1/2007 Young-Chul ..... 300/21
7,293,318 B1 * 11/2007 Kuo ..... 15/167.1
7,419,225 B2 * 9/2008 Fischer et al. ..... 300/21
7,478,960 B2 * 1/2009 Glover ..... 401/188 R
2002/0184719 A1 * 12/2002 Eliav et al. ..... 15/22.1
2011/0057501 A1 * 3/2011 Chee et al. ..... 300/21

* cited by examiner

*Primary Examiner* — Monica Carter
*Assistant Examiner* — Michael Jennings
(74) *Attorney, Agent, or Firm* — Alberto Q. Amatong, Jr.; The Amatong Law Firm, PLLC

(57) ABSTRACT

A toothbrush is provided having an elongated handle and a brush head supported by the handle. The brush head has a base and a plurality of bristles that are arranged in sections. Each section has bristles that extend from the base to form a contact surface elevated from the base. One or more of the sections include bristles that extend to varying lengths from the base to form a contact surface that inclines or declines relative to the base. The sections of bristles further include a first outside section having a contact surface that declines inwardly, an inside section, adjacent the first outside section, having a contact surface that declines outwardly toward the first outside section, and a second outside section positioned adjacent an opposite side of the inside section from the first outside section. The second outside section has a contact surface that declines inwardly toward the inside section.

20 Claims, 9 Drawing Sheets

TOOTHBRUSH AND METHOD OF USING THE SAME

This application claims the benefit of the filing date of U.S. Provisional Application Ser. No. 60/961,572, filed on Jul. 23, 2007 (now pending). The above application is hereby incorporated by reference for all purposes and made a part of the present disclosure

BACKGROUND OF INVENTION

The present invention relates generally to toothbrushes, related methods of use, and accessories therefor and thereof.

A large number of toothbrush designs have been employed and commercialized. Some of these designs have focused on features that are relevant to cleaning and care of the gum areas as well as the teeth. Although some of these designs have proven generally effective, there remains a need for an improved toothbrush that is practical in design and employment, effective in general cleaning of the teeth, and also efficient in cleaning and caring for the gum areas surrounding the teeth. There is a further need for such a toothbrush that can address problem areas associated with gingivitis, particularly the cleaning of the gingival sulcus. Periodontis may arise from gingivitis that initially forms in the gingival sulcus. Problem areas further include the lingual surfaces of the mandibular molars, and the buccal surfaces of the maxillary molars. The present invention addresses the need for toothbrushes that are particularly suited for addressing all of these areas, without sacrificing utility and effectiveness in cleaning the more common areas of the teeth.

SUMMARY OF INVENTION

In one aspect of the present invention, a toothbrush is provided having an elongated handle and a brush head supported by the handle. The brush head has a base and a plurality of bristles that are arranged in sections. Each section has bristles that extend from the base to form a contact surface elevated from the base. One or more of the sections include bristles that extend from the base to form a contact surface that inclines or declines relative to the base. The sections of bristles further include a first outside section having a contact surface that declines inwardly, an inside section, adjacent the first outside section, having a contact surface that declines outwardly toward the first outside section, and a second outside section positioned adjacent an opposite side of the inside section from the first outside section. The second outside section has a contact surface that declines inwardly toward the inside section. Preferably, the inside section(s) and outside section, and the contact surfaces thereon, are configured to engage the target tooth in a predetermined orientation.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The present invention relates generally to toothbrushes that are particularly suited for addressing problem areas associated with gingivitis. In one aspect of the invention, the toothbrush provides a brush head that is adapted to engaging a target tooth in a predetermined orientation. In particular, the inventive toothbrush and the brush head are configured to engage a tooth in accordance with the ADA approved modified bass technique.

Figure 1:
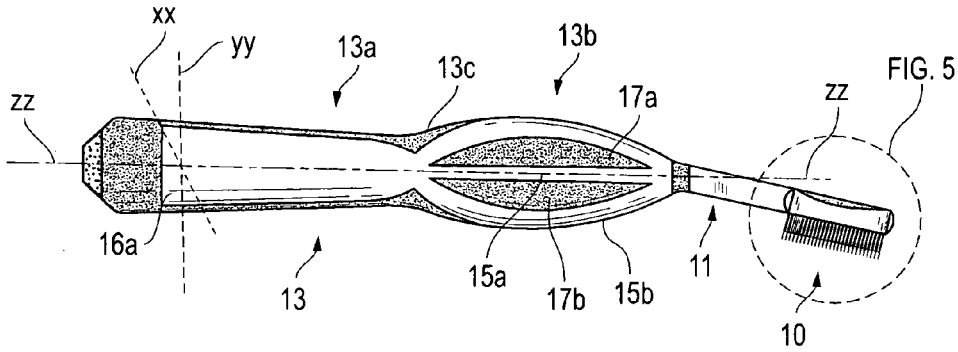
FIG. 1 is a side view of a toothbrush according to the present invention.
Figure 2:
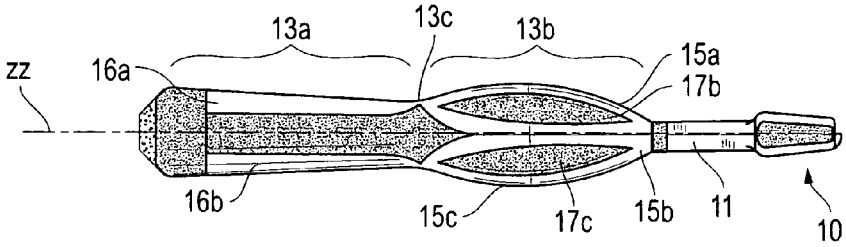
FIG. 2 is a top view of the toothbrush in FIG. 1.
Figure 3:
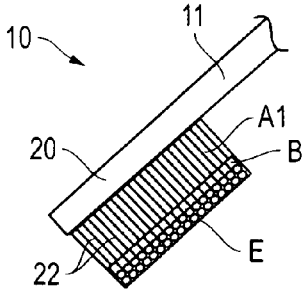
FIG. 3 is a detail view of a brush head of the toothbrush in FIG. 1.
Figure 4:
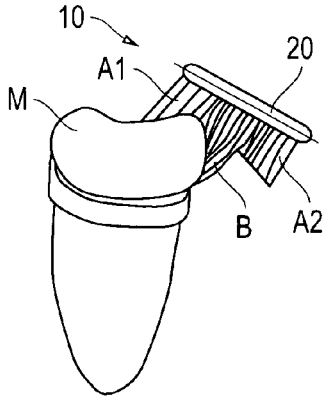
FIG. 4 is an end view illustration of the brush head properly engaging a target tooth, according to the present invention.

FIGS. 1 and 2 depict a toothbrush 1 embodying preferred aspects of the present invention. FIGS. 3 and 4 depict preferred configurations of a brush head 10 as an advantageous component of the toothbrush 1. In this embodiment, the toothbrush 1 includes an elongated handle 13, an angled stem 11, and a brush head 10 connected to the handle 13 by way of the stem 11. For present purposes, the brush head 10 is described as being positioned at or near the proximal end of the toothbrush 1, while the handle 13 is described as extending to a distal end of the toothbrush 1. The stem 11 may be referred to as a component of the brush head 10 rather than a separate component of the toothbrush 1. Thus, the brush head 10 may be described as being connected (i.e., directly connected) to the handle 13.

It should first be noted that various aspects of the present invention are described herein. These various aspects are particularly suited to, or for, a toothbrush of conventional usage. To illustrate the invention and preferred embodiments of the invention, much of the following detailed description is provided in the context of that toothbrush and such a toothbrush having multiple advantageous components, each of which represents a novel contribution to the art by the applicant. It is contemplated that various aspects of the inventive toothbrush, i.e., components thereof, may be applicable to other toothbrush designs and/or toothbrush accessories and/or combinations. For example, the preferred brush head configuration detailed below may be integrated with a toothbrush having a different handle design and/or a stem different from that depicted in the Figures. The detailed description and exemplary embodiments should not, therefore, be construed as limiting the invention to the structures, configurations, and methods described herein.

The top view of FIG. 2 is one that is revealed by rotating the toothbrush 1 in the side view of FIG. 1 a quarter turn or 90° about its center axis ZZ from its start position. For purposes of describing the operation of the toothbrush 1 according to the invention, center planes or centerlines XX, YY will be referred to be as being fixed imaginary reference planes having a common intersection or axis ZZ extending through the toothbrush 1 and about which the toothbrush 1 is rotated.

In a preferred embodiment, the stem 11 is positioned at an angle of about 10° from the generally linear handle 13. As is generally known, the position of the stem 11 relative to the handle 13 facilitates placement of the brush head 10 in an advantageous position during use, particularly in accordance with an effective brushing method of the present invention. The handle 13 has a generally cylindrical shape that is balanced about a central axis ZZ, and further, about a lateral center plane XX and a vertical center plane YY. The curved and contoured shape of the handle 13 facilitates gripping and manipulation of the toothbrush 1. As shown herein, the shape of the present inventive handle 13 also facilitates positioning and proper use of the brush head 10.

It is noted that embodiments of the invention may or may not include a stem 11 or a cylindrically-shaped handle 13 a shown in FIGS. 1 and 2, without departing from the invention. For example, in some embodiments, the brush head 10 may extend directly from the linear handle 13 and positioned about the centerline ZZ. In other embodiments, the brush head 10 may be integrated with a conventional straight and thin handle.

In accordance with the present invention, the handle 11 may be further divided into two sections—a palm grip section or palm grip 13*a* extending immediately from the proximal end of the handle 13 and an intermediate section 13*b*. Each of the handle sections 13*a*, 13*b*, has a generally curved contour that interface to provide an indented section or valley 13*c*. The rounded grip 13*a* and the valley interface 13*c* generally provides a main grip and fulcrum during manipulation of the toothbrush 1. In this preferred embodiment, the palm grip 13*a* is formed from two halves 16*a*, 16*b* each having a generally convex surface or contour. This shape is particularly accommodating to the fingers and palm as the user grips the handle 913.

As will be further discussed below, the specific shape of the handle 13 also functions as a guide and/or an indicator for positioning the brush head 10 to a predetermined position relative to a target tooth, according to the present invention. In particular, the handle 13 provides, in one aspect of the invention, an indicating means or guide for proper positioning of the brush head 10 relative to a target tooth. More particularly, the handle 13 provides a means for guiding the brush head 10 to a predetermined orientation.

In this particular embodiment of the invention, the intermediate section 13*b* is generally formed from an ovoid shaped portion of the handle 13. In one respect, the ovoid portion has four separate cutouts or flat surfaces that provide, in this embodiment, thumb rests 17*a*, 17*b*, 17*c*, 17*d*. These flat surfaces 17*a*-17*b* provide a convenient and effective surface upon which the thumb may apply pressure to the handle 13, and correspondingly to a target tooth engaged by the brush head 10. Accordingly, the section 13*b* may also be referred to as the thumb press section 13*b*.

Figure 5:
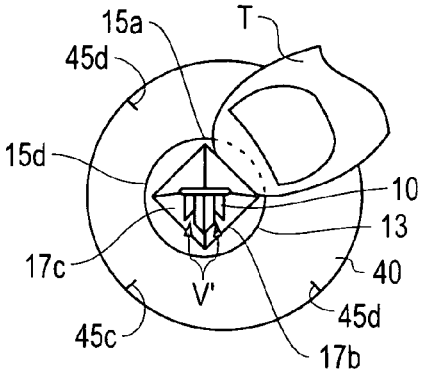
FIG. 5 is a simplified proximal end view of a toothbrush illustrating a brush head orientation guide, according to the present invention.
Figure 5A:
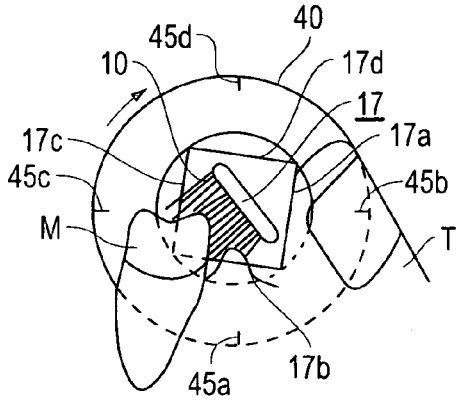
FIG. 5A is a simplified illustration of the toothbrush in FIG. 5 engaging a target tooth while in a predetermined orientation after adjustment.
Figure 5B:
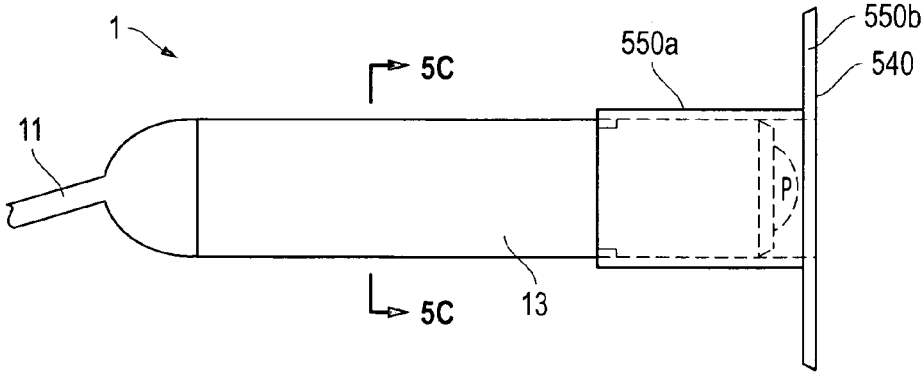
FIG. 5B is a partial side view of a toothbrush having an alternate brush head orientation guide, according to the present invention.
Figure 5C:
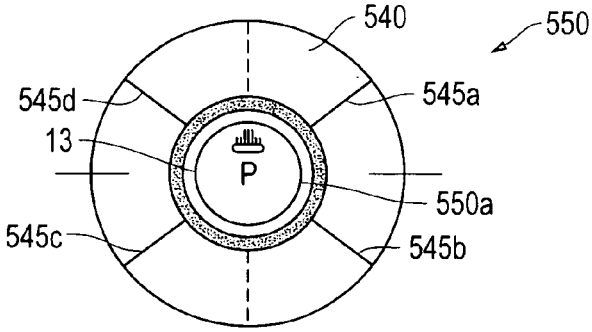
FIG. 5C is a cross-sectional end view of the toothbrush in FIG. 5B illustrating the brush head orientation guide at a position corresponding to an orientation of the brush head prior to proper adjustment relative to a target tooth.

As further illustrated by FIGS. 5 and 5A, the flat surfaces 17*a*-17*b* define a generally box-shaped mid-section 17 of the thumb press section 13*b*. As shown in the simplified illustration of FIG. 5, the "box" 17 is generally aligned 45° from the plane of the brush head 10. The box also defines separate ridges or ribs 15*a*, 15*b*, 15*c*, 15*d* that are spaced apart by 90°. The ribs 15*a*-15*d* serve as orientation indicators for the user during use of the toothbrush 1.

Turning to FIG. 5, a thumb T of a right hand of a user is shown resting on one of the thumb rests 17*a* of the toothbrush 1. In the orientation depicted by FIG. 5, the toothbrush 1 and, more particularly, the brush head 10, may be referred to as being in the initial or start position. The user applies a standard hand grip to manually grip the handle of the toothbrush. The user's four fingers and palm are generally engaged about the palm grip 13*a* while the user attempts to find the appropriate thumb rest 17*a*-17*b* for the thumb T. In the orientation depicted in FIG. 5, the user cannot accommodate the toothbrush 1 with a standard grip because the palm and fingers would be rotated exceedingly forward of a comfortable position for the hand. An attempt to adjust the grip to a comfortable position ultimately results in the user adjusting the orientation of the toothbrush 1, resulting in the position and orientation of the brush head 10 as depicted in FIG. 5A. In other words, adjustment of the handle 13 by the user to a comfortable position for the handle grip directly results in adjusting the orientation of the brush head to a secondary orientation. This secondary orientation is provided by design and thus, is referred to as a predetermined orientation of the toothbrush 1 and further, the brush head 10. In an important aspect of the invention, the predetermined orientation corresponds to an optimal position of the brush head 10 relative to a target tooth.

Accordingly, FIG. 5A illustrates the use of a standard grip by the user and the predetermined orientation of the toothbrush 1 and brush head 10 which accommodates that standard grip. In this predetermined orientation, the box has been rotated approximately 45° and is aligned vertically and laterally. At the same time, the brush head 10 has been rotated from a vertical orientation to the predetermined orientation (a span of about 45°). As will be described below, this predetermined orientation results in proper engagement of the brush head 10 with a target tooth.

It should be noted that, by design, the orientation depicted in FIG. 5A is generally the only orientation that will accommodate the standard grip by the user manipulating the toothbrush 1. Any other orientation, would not comfortably accommodate the user's standard grip. In this respect, the box and thumb rest design of the inventive toothbrush functions as an operating guide to the user, directing the user to the corresponding proper orientation and position of the brush head 10 relative to a target tooth (i.e., a brush head orientation guide).

In this respect, the box 17 (including the ribs 17*a*-17*d*) provided thereon, may be referred to as a brush head orientation guide means. Also, in the predetermined orientation of the toothbrush, the thumb is optimally positioned to apply pressure to the toothbrush 1 and correspondingly, to a target tooth engaged by the brush head 10.

Figure 11:
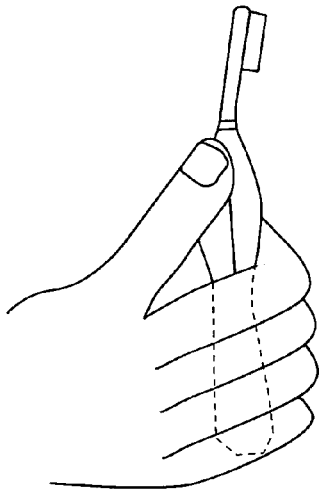
FIG. 11 is a simplified illustration of a "standard grip" as employed by a user of a toothbrush.

A "standard grip" is illustrated in FIG. 11. This illustration shall serve as support for the meaning of a "standard grip" in the context of design and structural features of a toothbrush and/or brush head according to the invention. It should also be noted that the meaning and application of this term will be understood by one skilled in the relevant dental or consumer products art without explanation from herein.

In the embodiment illustrated in FIGS. 1 and 2, the palm grip 13*a* is approximately 3¾" long and the thumb press 13*b* is approximately 2³⁄₁₆" long. The brush head 10, including the stem 11 extends generally 2³⁄₁₆" from the thumb press 13*b*. Preferably, the stem 11 is positioned at an angle of about 30° from the lateral center line XX of the toothbrush 1 (in FIG. 1).

Figure 3A:
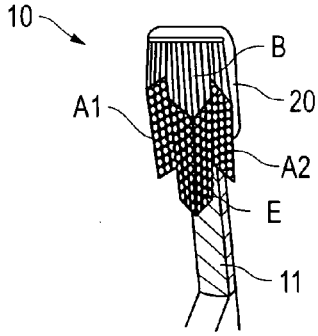
FIG. 3A is a plan view of the brush head in FIG. 1.
Figure 3B:
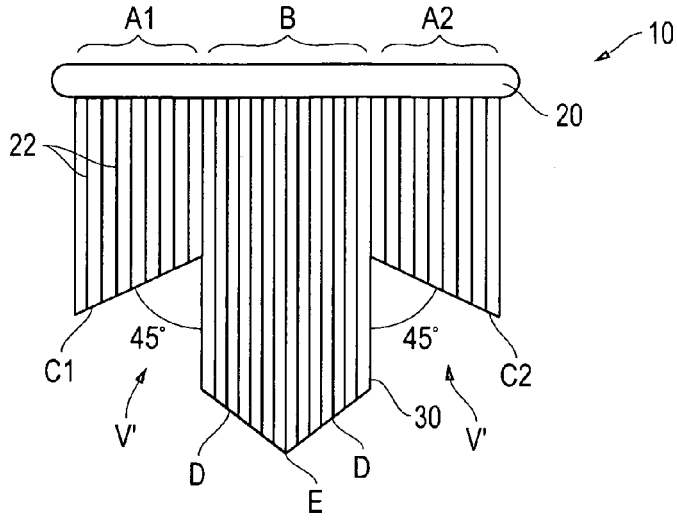
FIG. 3B is a proximal end view of the brush head in FIG. 2.

Turning now to FIGS. 3, 3A, and 3B, a brush head 10 is shown having multiple sections of bristles illustrated in accordance with a primary aspect of the invention. FIGS. 3A, 3B, and 3C are simplified illustrations provided to facilitate description of a preferred embodiment and should not be construed in any way to limit the invention. As best shown in FIGS. 3A and 3B, the preferred brush head 10 includes three distinct sections or arrangement of bristles: an outside section A1, an inside section B, and a second outside section A2 adjacent a side of inside section B opposite of the outside section A1. As generally known in the art, the brush head 10 is comprised of a population of bristles that are clumped or grouped together in tufts 22. The brush head provides a base or platform 20 from which the bristles and the tufts 22 extend outwardly and generally perpendicularly to the base 20 (see e.g., end view of FIG. 3B). The bristles and the tufts 22 may be implanted or attached to the base 20 in a variety of suitable methods known in the art. Each of the bristle sections A1, B, A2 is formed by a plurality of generally equally spaced apart tufts 22. Each tuft 22 is further formed by bristles of a substantially common length. Each tuft 22 (and each bristle in the tuft 22) extends from the base 20 to a free or exposed end. Together with adjacent tufts 22, these exposed ends begin to form an exposed surface. The exposed surface is referred to herein as a "contact surface" because it is intended for directly contacting and engaging the target tooth. As used herein, a "contact surface" is provided by a collection of free ends of bristles that extend generally perpendicularly from the base, whether in groups of tufts or individually. Furthermore, as used herein, the contact surface and the free ends of the bristles are referred to as being "elevated" from the base 20, which means simply that there is a measurable separation (depth, height, or width) from the base 20.

In one arrangement of tufts 22, the tufts 22 in each section are generally aligned to form a row, as illustrated in FIGS. 3A and 3B. The rows of tufts 22 in this embodiment are generally provided by bristles having generally the same length. Thus, the tufts 22 along a row extend from the base 20 to a common elevation (relative to the base 20). Referring to FIG. 3B, the elevation of the rows in sections A1, A2, in this particular embodiment, gradually declines with each successive row in a direction toward the center of the base 20 (inwardly direction). In this manner, the rows or tufts 22 form a contact surface C1 and C2 that declines inwardly toward the inside section B.

The inside section B further consists of tufts 22 and further, rows of tufts that are distinct from those of the outside sections A1, A2. The inside section B consists of tufts that extend outwardly to form a contact surface D that, in one embodiment, is separate and disjointed from the outside contact surfaces C1 and C2. In the preferred embodiment, the elevation of the contact surface D also varies across the inside section B, and does not provide a single planar surface. The contact surface D is actually two separate but congruent planar surfaces. Simply, the tufts 22 are taller with each successive row toward the center. As a result, two surfaces meet at a middle ridge E. The contact surface D is also referred to as declining outwardly from the ridge E toward each of the outside sections A1 and A2.

Moreover, because the tufts 22 of the inside section B are generally longer or taller than those of the outside sections A1, A2, the contact surface D is elevated above the outside contact surfaces C1, C2. In this embodiment, a side wall 30 of the inside section B is exposed and juxtapositioned with the outside sections A1, A2 and the contact surfaces C1, C2, thereon. Referring to FIG. 3B, the juxtapositioning of the sidewall 30 with the contact surfaces C1, C2, provides a V-shape space or profile, V' (simply, "V-space V'") that becomes particularly functional during use of the toothbrush 10. Preferably, the V-space V spans up to approximately 45°.

In an alternative embodiment of the brush head 10 as best illustrated in FIGS. 5 and 5A, the contact surfaces C1, C2, does terminate or meet with the inside contact surfaces D. In these embodiments, the inside section B does not provide an exposed sidewall 30. Contact surfaces C1, C2, and D have a common low point or lowest elevation. Accordingly, the V-space V provided by this alternative brush head 10 is defined by the profiles of the inside contact surface D and the outside contact surface C1 or C2 and the adjacent contact surface D.

In further embodiments, the contact surfaces C1, C2, and D may have a smoother, more rounded profiles. The interface between the contact surfaces may also be more gradually, with less of an abrupt angle. Such a brush head configuration would still provide an advantageous V-space, in accordance with the present invention.

Furthermore, the bristles or tufts 22 of the outside sections A1, A2 may be made stiffer than the bristles or tufts 22 of the inside section B. This difference in stiffness may be accomplished by varying the length or width of the respective bristles, using different materials, and/or employing other means generally known in the art.

More preferably, the bristles of the inside section B is provided a color different from the colors of the bristles of the outside sections A1, A2. For example, the bristles of the inside sections, or at least the contact surfaces D of the outside section, may be provided in red, while the bristles or contact surfaces C1, C2, of the outside sections are provided in white. As will be further described below, these color and stiffness distinctions provide functional advantages and yet another brush head orientation guide according to the present invention. Some of these functional advantages may be evident in the illustrations of FIGS. 4 and 6-8, and the descriptions provided below.

Generally, the physical and geometrical configuration of the inside and outside sections, particularly the relative positioning of the respective contact surfaces, are adapted for engaging a target tooth, such as a mandibular molar. More specifically, the multi-section brush head configuration is configured to engage the target tooth in a predetermined manner. This predetermined manner, or more specifically, predetermined position or orientation, functions as a guide and then, as an indicator to the user of proper position of the brush head during brushing. More specifically, the brush head, through its multiple sections and contact surfaces, is configured to engage the target tooth in a particularly suitable orientation of the brush head. In accordance with the invention, the brush head configuration corresponds with the profile of the target tooth in a manner and orientation that is particularly effective in brushing and caring of the tooth and gum areas. In particular, the physical configuration of the brush head, while in the predetermined orientation positions the inside section and more particularly, the ridge, to penetrate the gingival sulcus.

Now turning to FIG. 4, the brush head 10 according to the present invention is shown positioned at the predetermined orientation. In this respect, the brush head 10 is shown in its proper or predetermined orientation, relative to the target tooth M, which in this case is a mandibular molar. In this predetermined orientation, the V-space V of the brush head 10 accommodates the top curvature and dual surfaces of the mandibular molar M. The outside contact surface A1 is placed against a gingival side of the target tooth M, when the v-space accommodates the target mandibular molar. In correspondence, the contact surface D of the inside section is placed against an occlusal surface of the molar M, while the bristles proximate the ridge E of the inside section D penetrates the gingival sulcus. Meanwhile, the shorter bristles of the outside section A1 scour the tooth's occlusal or biting surface. In this way, the brush head 10 is used more effectively to clean and care for the mandibular molar M and the surrounding gum areas.

Because of the geometric configuration of the brush head 10, particularly the provision of the V-space V, the predetermined orientation shown in FIG. 4 is readily recognized by touch to the user. As illustrated in FIG. 4, the v-space corresponds with the corner and curvature of the mandibular molar, thereby wedging or locking the v-space and the brush head against the molar—in the proper orientation.

Figure 4A:
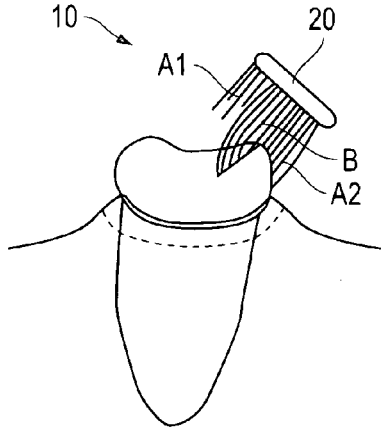
FIG. 4A is an end view illustration of the brush head in FIG. 4 engaging the target tooth prior to adjustment.

To illustrate further, FIG. 4A depicts a brush head 10 improperly positioned relative to the target tooth M. In this position, the inside section A1, A2 of the brush head 10 is not engaging and penetrating the gingival sulcus. To further contrast, the brush head 10 is generally resting atop the tooth M by way of thumb pressure, but not engaging the tooth M. The brush head 10 is tentatively engaging the tooth M and easily slips off the tooth's surface. By rotating and/or adjusting the brush head 10 until it engages and locks on to the profile of the tooth M, the brush head 10 is brought to the predetermined orientation relative to the target tooth M, as shown in FIG. 4.

In the preferred embodiment, the bristles of the inside sections are longer than those of the outside sections so as to more easily penetrate the gingival sulcus. In this manner, the bristles in the inside section also more effectively brushes against the generally vertical side wall of the molar. The brush head 10 is applied to the mandibular molar and the adjacent gingival sulcus. The bristles are advantageously positioned for cleaning the tooth's occlusal surface 31 and under the adjacent gingival sulcus 32.

To further aid and guide the user, the toothbrush 1 is provided another means for guiding the brush head 10 to the predetermined orientation to the user. By distinguishing the colors of the outside section and the inside section, the user can observe how close the brush head 10 is to the predetermined orientation. In the predetermined orientation, the white color of the bristles of the outside section A1, A2 will be well separated and independent of the red bristles of the inside section C. Thus, if the user observes meshing and mixing of different colors, rather than separation, that becomes an indication to the user that the orientation of the brush head 10 must be adjusted. The user may make several adjustments as required to create the color separation, and thus positioning the brush head 10 in the proper and predetermined orientation.

To further illustrate, in FIG. 4A, the colors of the inside section is mixed in and meshes with the colors of the outside section. In contrast, FIG. 4 clearly shows separation between the colors of the bristles of the inside section from the colors of the bristles of the outside section A1. In this respect, color arrangement of the brush head 10 may be characterized as providing a visual means for guiding the brush head 10 into the predetermined orientation (i.e., a visual or observable brush head orientation guide).

Figure 6:
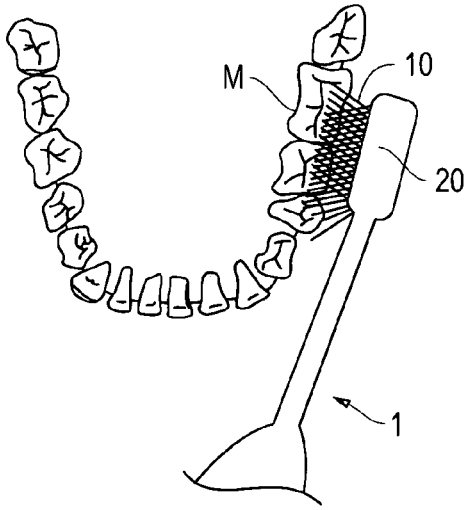
FIG. 6 is a top perspective view of the toothbrush in FIG. 1 engaging a mandibular molar(s) according to the present invention.

FIG. 6 further illustrates the predetermined position and orientation of the brush head relative to a target mandibular tooth. From the top view, only the color of the brushes of the outside section A1, A2 is readily evident.

Figure 7:
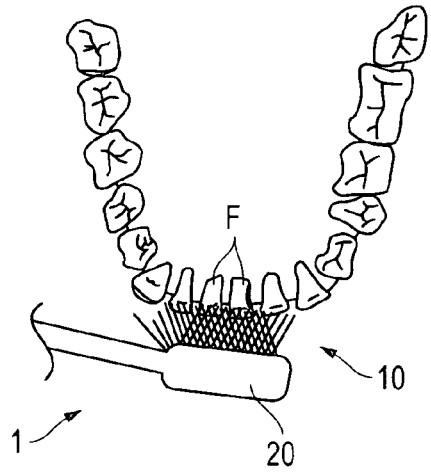
FIG. 7 is a top perspective view of the toothbrush in FIG. 1 engaging a plurality of front teeth according to the present invention.
Figure 8:
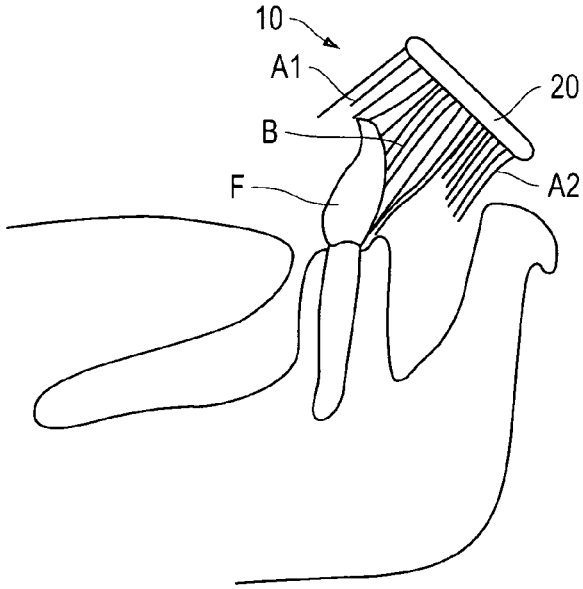
FIG. 8 is an end view from inside the user's mouth of the toothbrush in FIG. 7 engaging a target canine tooth in FIG. 6.

Turning now to FIGS. 7 and 8, the toothbrush 1 according to the invention, is shown used for brushing the front teeth F. In FIG. 8, the brush head 10 is shown properly engaging a canine tooth F. In the proper orientation, the color brushes of the inside section again A1 properly engages the gingival side of the canine tooth F, while the bristles approximate the ridge E of the inside section B effectively penetrates the gingival sulcus. At the same time, the contact surface C1, C2 of the outside section A1, A2 engages the top of the canine tooth.

In a further aspect of the present invention, a preferred embodiment of the toothbrush 1 includes yet another means for indicating or guiding the user to proper orientation of the brush head relative to a target tooth (brush head orientation guide). In this embodiment, the inventive toothbrush 1 provides yet another readily observable guide for the user. Returning to FIG. 5, the end profile of the toothbrush 1 provides a ring 40 that is directly observable to the user. The brush head orientation ring 40 also includes indicator lines 45*a*, 45*b*, 45*c*, 45*d*. In the flat or initial position of the toothbrush as depicted in FIG. 5, the lines 45*a*-45*d* are at the 45° positions of the ring 40. In FIG. 5A, the toothbrush 1 has been rotated to place the brush head 10 in the predetermined orientation. In this view, the brush head 10 is at an orientation corresponding to that shown in FIG. 4. At this predetermined orientation, the indicator lines 45*a*-45*d* have been rotated to align with the horizontal and lateral centerlines. This alignment, and the rotation required to arrive in alignment, are readily observable by the user. Thus, the user can rotate and adjust the toothbrush 1 (and the brush head 10) until the indicator lines 45 align with the centerlines XX, YY, thereby indicating placement of the brush head 10 in the predetermined orientation.

It will become apparent that a user of the inventive toothbrush will most likely use the V-space V and/or the box 17 to first physically guide the brush head 10 to the proper orientation and then, check secondary means to confirm such placement. In this context, the color distinction provided by the bristles of the brush head 10 and the orientation ring function as secondary means of guiding the brush head to the predetermined orientation.

It should be noted that in illustrations and discussions provided herein, the indicator lines 45, as well as the span of the V-space V have been provided at approximately 45°. It should be noted that the v-space may be adjusted to another skewed angle different from 45°. In these case, the angular spacing of the indicator lines will vary accordingly.

Referring to the side view of a partial toothbrush 510 in FIG. 5A, an alternative indicator means 540 is shown as a separate component. The indicator means 550 is provided in the form of a cap having a hollow tube 550*a* and an angulation ring 540. By way of the tube 550*a*, the indicator means 550 may be fitted about the distal end of a handle 13 of a toothbrush 1. The tube 550*a* would be readily removed from the handle 13, as required by the user. The angulation ring 540 is similar to that previously described in respect to FIGS. 5 and 5A in that the ring 540 is an indicator to the user of the orientation of the brush head 10 relative to a target tooth. This particular embodiment does provide additional benefit in that the orientation guide 540 also functions as a stand for the toothbrush 1. In this way, the user may rest the toothbrush 1 on a surface using the guide 540 as a base.

Figure 9:
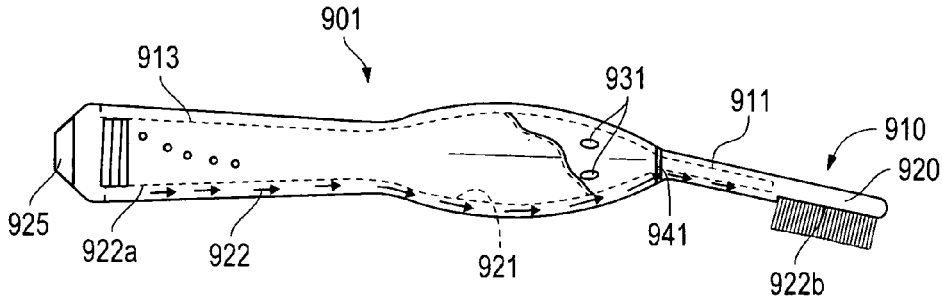
FIG. 9 is a side view cut-away of a toothbrush illustrating an antiseptic dispensing system according to the present invention.

Referring now to FIG. 9, an alternative embodiment of the invention is provided in the form of toothbrush 901. The toothbrush 901 includes an elongated handle 913, a brush head 910, and an angled stem 911 connecting the brush head 910 to the handle 913. It should be noted that this embodiment of the invention may, in further embodiments, employ one or more of the features previously illustrated and described in respect to FIGS. 1-8. Among these, of course, are a multi-sectioned brush head 910 and/or a multi-colored brush head and/or one or more of the brush head orientation guides previously described.

The inventive toothbrush 901 includes a pneumatic, manually-operable fluid dispensing system to assist proper brushing and cleansing of a target tooth. The fluid dispensing system preferably stores and dispenses an antiseptic mouthwash to assist in the cleaning of the gum areas of target teeth. The fluid dispensing system includes a reservoir 921 preferably formed within a hollowed handle 913. The fluid dispensing system further includes a conduit 922 fluidly communicating antiseptic from the reservoir 921 to the brush head 910. The conduit 922 is preferably a polymeric tube having an inlet 922*a* communicating with a distal region of the reservoir 921 and an outlet(s) 922*b* provided in the base 920 of the brush head 910. The outlet 922*b* may be further included with a tube extension that facilitates dispensing of the antiseptic through the multi-sectioned brush head 910 and onto the target tooth and, more particularly, the surrounding gum areas. As shown in FIG. 9, the conduit 922 also extends through the length of the handle 913 and the stem 911 before arriving at the brush head 910. In alternative embodiments, the conduit 922 may be directed substantially inside of the reservoir 921.

The fluid dispensing system further includes a pump 925 located on the distal end of the handle 913. The pump 925 is also equipped with a one-way check valve. As further illustrated in FIG. 10, the pump provides a deformable bulb that may be thumb-operated to increase the pressure in the reservoir 921 by adding air volume. As generally known in the art, the integrated one-way valve also prevents escape of fluid and air from the reservoir. The distal end of the handle 913 is preferably provided with a removal plug or threaded cap in which the pump 925 is integrated. In this way, the plug may be removed to provide access to the reservoir 921. Furthermore, o-rings may be placed about and adjacent the plug or cap to seal the reservoir. An additional o-ring is preferably placed in and about a threaded or plug connection 941 between the handle 931 and a removable stem 911 to effectively seal the reservoir at the proximal end.

The fluid dispensing system further includes a manually operable valve 931 for controlling release of antiseptic from a pressurized reservoir 921 and directing the antiseptic via the conduit 922 to the brush head 910. The valve 931 may be any suitable valve means, but preferably, a pinch valve having a bulb actuator. The valve 931 is preferably located between the brush head 10 and the distal end of the handle 913, i.e., in the thumb grip section 913*b*, so as to accommodate the normal placement of the user's thumb during brushing. In this way, the valve 931 may be easily thumb operated (i.e., a thumb valve 931). Moreover, the valve 931 is preferably engageable with the conduit 922 to restrict or allow fluid flow therethrough. It should be noted also that during brushing, the handle and reservoir will be tilted slightly such that the distal end of the handle 913 will be lower from the area of the valve 931. In further embodiments, the fluid dispensing system is integrated with handle designs such as those depicted in FIGS. 2-4. In these embodiments, the thumb valve is advantageously located on the appropriate thumb rest 17*a*-17*d*, thereby facilitating integration of the dispensing operation with the positioning of the brush head 910.

Accordingly, the fluid dispensing system embodies a manually-operable valve 931 the operation of which is facilitated by the design and shape of the handle and the inclusion of key components. By placing the inlet 922*a* near the distal end, positive liquid head may be created by vertically positioning the toothbrush 90. Additional head may be created by operation of the thumb-pump 925.

Figure 10:
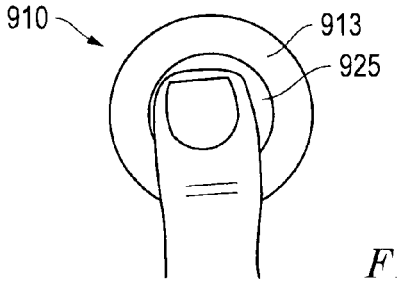
FIG. 10 is a detail view of a thumb pump component of the antiseptic dispensing system in FIG. 9.

It is contemplated that a preferred toothbrush 1 according to the invention will include a fluid dispensing system as illustrated in FIGS. 9 and 10, a brush head configuration as illustrated in FIGS. 3 and/or 4, or one more brush head orientation guides as illustrated in FIGS. 1-8 and described previously. During normal use of the toothbrush 1, a user may employ the V-space V and the box 17 to properly orient the brush head 10 relative to a target tooth. To further confirm proper orientation, the user may also use the color distinctions between the sections of the brush head 10 as a visual guide means, and/or an angulation ring 40. After proper adjustment, the brush head 10 may be employed to brush the target tooth in accordance with the ADA approved modified bass technique.

During such brushing, the user may operate the valve 931 to dispense and antiseptic mouthwash from the toothbrush through the base 920 of the brush head 10 and into the gingival sulcus. In this manner, the sulcus may be flushed with antiseptic, while the gum areas (and the tooth) may be mechanically cleaned with a particularly advantageous brush head and bristle, and contact surfaces thereof.

Thus, in a further aspect of the invention a toothbrush is provided with an integrated fluid dispensing system. An antiseptic mouthwash is stored in the reservoir for use during a secondary brushing session and for flushing the gingival sulcus, thereby killing more bacteria than brushing alone. The use of the inventive pneumatic-operated dispensing system with the inventive brush head ensures that the sulcus is properly deflected from the target tooth and allows the antiseptic mouthwash to flush the sulcus. This allows for a reduction of the number of inflammatory causing bacteria. When an individual rinses only with a mouthwash, the sulcus is not deflected laterally away from the tooth. Consequently, bacteria located in the lower ⅓ of the sulcus may not be removed. By deflecting the sulcus (through application of the inventive brush head), and then, flushing the area with antiseptic, more bacteria may be removed. A brushing procedure utilizing the invention should be employed as follows: (a) brush with toothpaste two minutes; (b) rinse; (c) brush with the brush head positioned in the predetermined orientation for forty-five seconds and periodically employing an antiseptic flush; and (d) floss.

Figure 12:
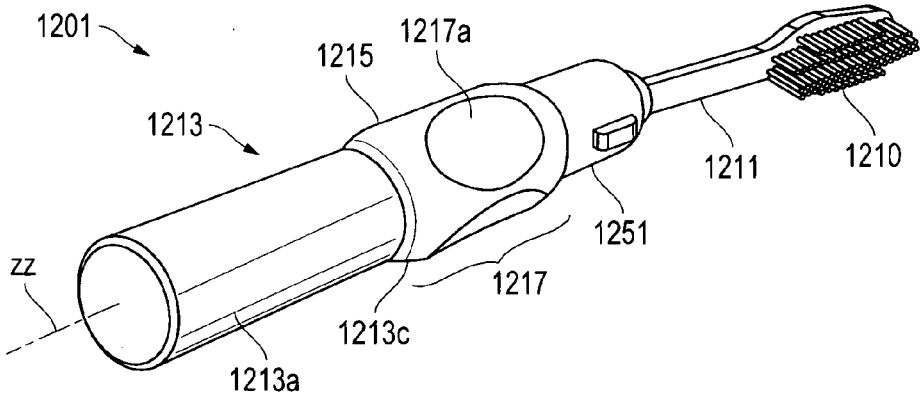
FIG. 12 is a perspective view of a toothbrush according to an alternate embodiment of the invention.

Referring now to FIG. 12, a toothbrush 1201 is depicted in accordance with an alternative embodiment of the invention, wherein like elements are referenced by like reference numerals. Like the toothbrushes in previous embodiments, the toothbrush 1201 includes a brush head 1210, a stem 1211, and an elongated handle 1213 into which the stem 1211 is removably secured. The elongated handle 1213 may be further divided into a palm grip section 1213*a*, an intermediate or thumb press section 1213*b*, and a valley interface 1213*c* therebetween. The palm grip section 1213*a* in this embodiment is generally symmetric and cylindrical. The intermediate or thumb press section 1213*b* includes a thumb press box 1217 having a series of ridges 1215*a*-1215*d*, and concavely shaped thumb presses or surfaces 1217*a*-1217*d*. The concave presses 1217*a*-1217*d* provide a convenient and effective surface upon with the thumb may apply pressure to the handle 1213, and correspondingly to a target tooth engaged by the brush head 1210, in a similar manner as described previously. As also similarly described previously, the "box" 1217 is generally aligned 45 degrees from the plane of the brush head 1210. The ridges 1215*a*-1215*d* may serve as orientation indicators for the user during use of the toothbrush 1201. Notably, the box 1217 in this embodiment does not extend to the proximal end of handle 1213, and instead stops short, thereby defining a forward section 1213*d* positioned between the box 1217 and the stem 1210.

Figure 12A:
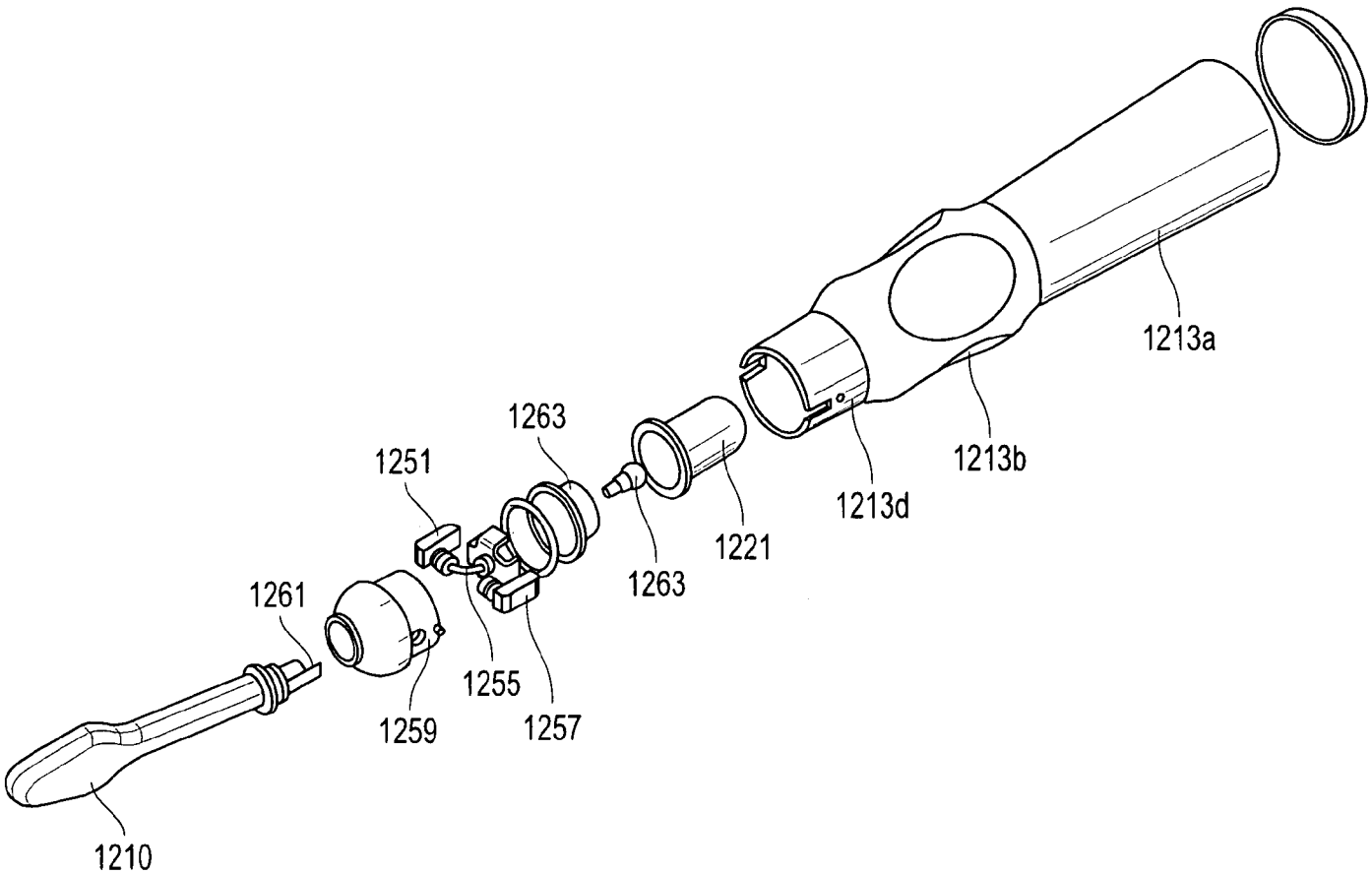
FIG. 12A is a reverse perspective and exploded view of the toothbrush in FIG. 12.
Figure 12B:
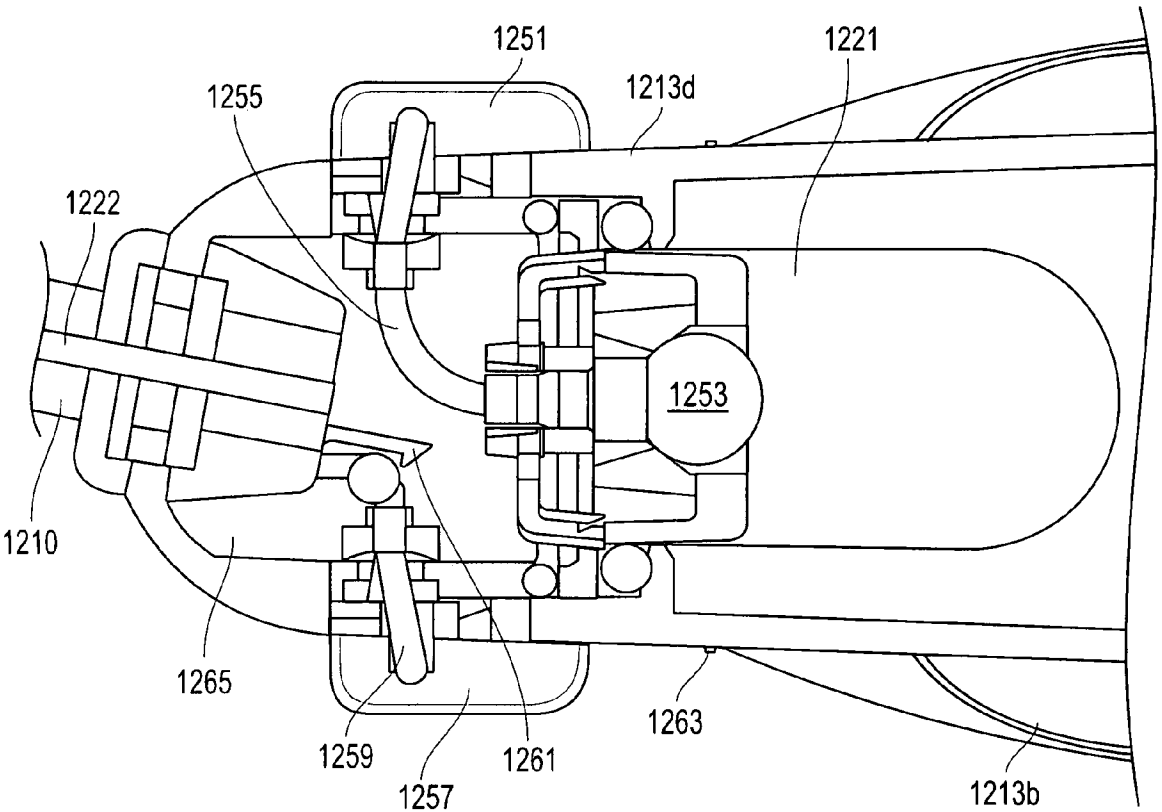
FIG. 12B is a detail, cross-sectional view, of a portion of the toothbrush in FIG. 12.

As in previous embodiments, the handle 1213 is preferably generally hollow so as to contain internal components of the toothbrush 1201, and more particularly, components of a manually and user-operable fluid dispensing system of the toothbrush FIG. 12A provides an exploded view of the toothbrush 1201, further revealing the internal components of a fluid dispensing system generally situated within the thumb press section 1213*b* and forward section 1213*d* of the handle 1213. FIG. 12B provides a further detailed illustration of the components of the fluid dispensing system according to this embodiment. The primary components of the fluid dispensing system are generally situated within the hollow of the forward section 1213*d*, and within the hollow of, at least, the front or forward portion of thumb press section 1213*b*. The fluid dispensing system includes an inflatable bladder 1221 that functions as a reservoir of the desired fluid, e.g., antiseptic. In FIG. 12B, the bladder 1221 is shown in a partially inflated state. In a fully inflated state, the bladder 1221 according to various embodiments may fill a substantially larger portion of the hollow of the handle 1213.

The fluid dispensing system further includes a ball valve 1253 shown seated to block a primary port 1263 of the bladder 1221. The port 1263 communicates the bladder 1221 with a sealed forward container 1265 of the reservoir. The sealed container 1265 is substantially smaller than the inflated bladder 1221 and is generally defined by the inside surface of the forward section 1213*d* and the base of stem 1211.

Figure 12C:
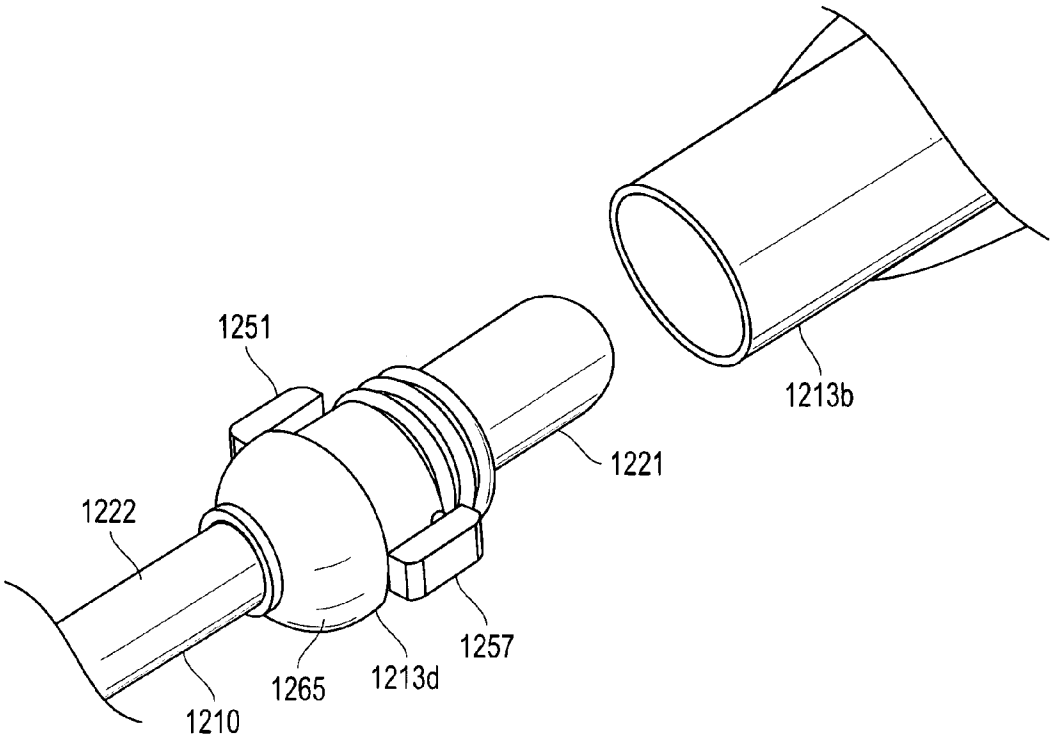
FIG. 12C is a detail illustration of a handle of the toothbrush in FIG. 12, wherein a forward section is disengaged from a main section of the handle of the toothbrush.

FIG. 12C illustrates a preferred feature of the toothbrush 1201. The container 1265 and forward section 1213*d* of the handle 1213 are designed and fitted to removably detach from the rest of the handle 1213. In this embodiment, the bladder 1221 is secured to the container 1265 (thereby maintaining the sealed reservoir) and is movable therewith. The container 1265 and the bladder 1221 together provides a pressurized reservoir of antiseptic that is situated to fluidly communicate with a conduit 1222 that leads to the brush head 1210, as described previously.

The ball valve 1253 is mechanically connected with a rigid member or line 1255 that is directed outwardly from the center of the container 1265 and through the outside surface of the forward section 1213*d* (i.e., at the handle 1213). As shown in FIG. 12B, the distal end of the rigid line 1255 is situated in a recess that is covered by a button The button 1251 is positioned on the outside of the forward section 1213*d* and may be depressed to move the rigid line 1255. Upon engagement and depression by the user, the button 1251 moves the rigid line 1255 to unseat valve 1253. As a result, the port 1263 is opened, thereby communicating antiseptic into and pressurizing the container 1265, and then further, fluidly communicating with conduit 1222. By releasing button 1251, the rigid line moves and reseats ball valve 1253 to block the port 1263. Thus, the button 1251 and the rigid line 1255 attached therewith provide a user-operable mechanism or means for operating the fluid dispensing system of the toothbrush while the toothbrush 1201 is in brushing mode. Furthermore, the mechanism or means (including button 1251) is provided at a location on the handle 1213 so as to be readily accessible and manually-operable simultaneous with the user's operation of the handle 1213.

FIG. 12B also illustrates a stem release system of this embodiment of the invention. This stem release system includes a button 1257 (also accessible at the handle) that may be depressed to move a lever 1259. The lever 1259 is a rigid, elongated member having a turned end section. The turned end section of lever 1259 engages an extended latch 1261 that is connected with the stem 1211. By depressing button 1257, the lever 1259 disengages the latch 1261, which disengages stem 1211 and allows stem 1211 to be removed from the handle 1213. In further embodiments, the stem 1211 may be removed to reveal an opening into which a bottle of antiseptic may be engaged. In this manner, the bottle of antiseptic may be used (i.e., by squeezing) to refill the bladder 1221, and, at the same time, pressurize the fluid dispensing system.

In further embodiments, the forward section 1213*d* may be eliminated by extending the thumb press section 1213*b* substantially to the proximal end of the handle In this way, the sealed container 1265 is located within the thumb press section 1213*b*. Furthermore, the buttons 1251, 1257 may be located underneath the thumb press section 1213*b*, preferably at a position forward of the thumb press surfaces 1217*a*-1217*d*.

Figure 13:
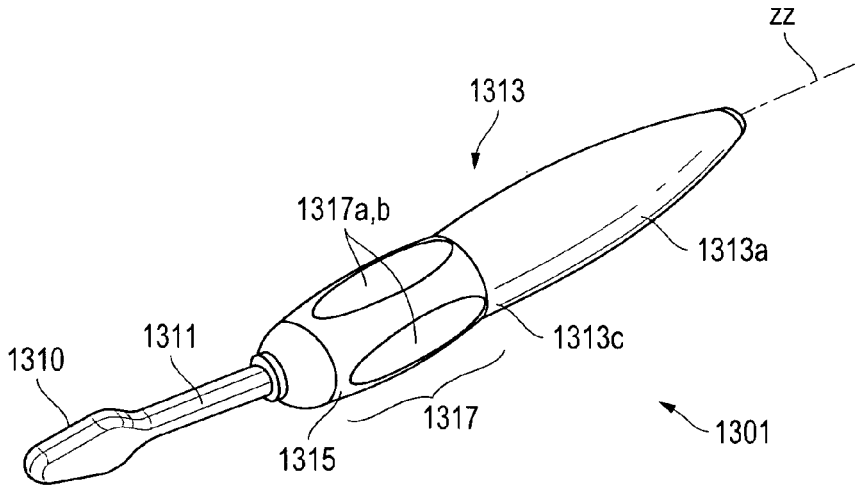
FIG. 13 is a perspective view of a toothbrush in accordance with yet another alternate embodiment of the invention.

Referring now to FIG. 13, a toothbrush 1301 is depicted in accordance with yet another embodiment of the invention, wherein like elements are indicated by like reference numerals. The toothbrush 1301 employs a handle 1313 that is generally more curved than the handles in previously described embodiments. In comparison to previous embodiments, the handle exhibits a more ergonomic approach. The handle 1313 fits firmly in the palm of the hand and the thumb press section 1312 allows for ergonomic placement of the thumb in one of the four flat areas on 1312. In a preferred embodiment, the fluid release button is located on the crest between flats 1317*a* and 1317*b*. A secondary button serving the same purpose may also be located 180 degrees from this button on the opposite side, thereby allowing two positions from which to dispense antiseptic. The toothbrush 1313 also provides for buttons similar in function as the buttons 1251, 1257 in FIG. 12. In this embodiment, the buttons (not shown) are located in the thumb press section 1315 of the toothbrush 1301. The buttons (not shown) are preferably located just forward of the thumb press surfaces (e.g., thumb press surface 1317*a* and 1317*c*), such that the buttons may be readily accessed and operated by the user.

The foregoing description of the present invention has been presented for purposes of illustration and description of preferred embodiments. It is to be noted that this description is not intended to limit the invention to the various systems, apparatus, structures, and methods disclosed herein. Various aspects of the invention, as described above, may be applicable to other types of toothbrushes and in combination with other toothbrush components. For example, the fluid dispensing systems may be incorporated in other toothbrushes having a different brush head design. Conversely, the brush head configuration illustrated in FIGS. 1-8 may be changed, without departing from the spirit of the invention. Furthermore, the brush head configuration may be employed with other toothbrush components different from that described in the preferred embodiments. Such variations of the invention will become apparent to one skilled in the relevant consumer products or dental, upon provision of the present disclosure. Consequently, variations and modifications commensurate with the above teachings, and the skill and knowledge of the relevant art, are within the scope of the present invention. The embodiments described and illustrated herein are further intended to explain the best and preferred modes for practicing the invention, and to enable others skilled in the art to utilize the invention and other embodiments and with various modifications required by the particular applications or uses of the present invention.

What is claimed is:

1. A toothbrush comprising:

an elongated handle; and a brush head supported by the handle and extending generally longitudinally from a first end proximate the handle, the brush head having a base, a longitudinal centerplane extending vertically through the base, and a plurality of bristles, wherein the plurality of bristles are arranged in sections, each section having bristles that extend vertically from the base to form a contact surface elevated from the base, said contact surfaces being discontiguous from one another and together forming a multi-level contact surface of the brush head;

wherein the sections of bristles include, a first outside section extending generally longitudinally atop the base to define a contact surface that declines inwardly from an outside side edge toward the longitudinal centerplane and to an inside side edge, a second outside section extending generally longitudinally atop the base to define a contact surface that declines inwardly from an outside side edge toward the longitudinal centerplane and an inside side edge, and an inside section extending generally longitudinally atop the base and having a central contact surface elevated above the base and above the inside side edges of the outside sections, such that the inside section reveals a pair of exposed vertical sidewall disposed between each inside side edge and the center contact surface, the contact surface of each inside section and each exposed vertical sidewall forming a generally v-shape cross-section.

2. The toothbrush of claim 1, wherein the bristles of the contact surface of the inside section are taller than the bristles of the contact surface of the outside sections.

3. The method of claim 2, wherein the inside section has at least two contact surfaces, including a first contact surface that declines outwardly toward the contact surface of the first outside section and a seconds contact surface that declines outwardly toward the contact surface of the second outside section.

4. The toothbrush of claim 3, wherein the inside and outside sections, and contact surfaces thereon, are configured such that the brush head is positionable to a predetermined orientation relative to a target tooth, wherein a contact surface of an inside section is placed against a gingival side of a target tooth as the adjacent contact surface of an outside section is placed against an occlusal surface of the target tooth.

5. The toothbrush of claim 4, wherein the generally v-shape cross section has a skewed angle less than 90°.

6. The toothbrush of claim 4, wherein the first and second contact surfaces of the inside section interface to form a longitudinally extending ridge of bristles, the ridge being adapted to penetrating a gingival sulcus at a position corresponding to the predetermined orientation.

7. The tooth brush of claim 4, wherein the bristles of the inside section has a first color and the bristles of one of the outside sections has a second color distinct from the first color, and wherein the bristles of the outside sections are shorter than the bristles of the inside section.

8. The toothbrush of claim 4, wherein the handle further includes a brush head orientation guide responsive to the positioning of the brush head such that the brush head is positionable to a predetermined orientation that corresponds with a predetermined orientation of the guide, and wherein the guide includes a box about a body of the handle alignable to an orientation corresponding to the predetermined orientation of the brush head.

9. The toothbrush of claim 8, further comprising a ring positioned about the handle and having indicators thereon indicative of the orientation of the brush head, the ring being detachable from the handle.

10. A toothbrush comprising:

an elongated handle;

a brush head supported by the handle, the brush head having a base, a longitudinal centerplane extending vertically through the base, and a plurality of bristles extending vertically from the base to form a multi-level contact surface of the brush head elevated above the base, wherein the plurality of bristles are arranged in sections including a first outside section extending vertically from the base to define a first outside contact surface section of the multi-level contact surface, a second outside section extending vertically from the base to define a second outside contact surface section of the multi-level contact surface, and an inside section positioned centrally about the longitudinal centerplane and extending vertically from the base to define a central contact surface section of the multi-level contact surface of the brush head; and a brush head orientation guide for indicating predetermined positioning of the brush head relative to a target tooth, the guide including a brush head lateral profile formed by the outside contact surface sections and the inside section of bristles, wherein each outside contact surface section declines inwardly toward an inside side edge proximate the inside section and the center contact surface section declines laterally outwardly, from a ridge of bristles, toward each of the outside contact surface sections, the center contact surface being elevated above the inside edges to form a generally v-shape profile of the brush head profile for simultaneously engaging the occlusal and gingival surfaces of a target tooth, as the ridge of the center contact surface engages the gingival succus of the target tooth; and wherein the inside section reveals a pair of exposed vertical side walls disposed between each inside side edge and the center contact surface, the contact surface of each inside section and each exposed vertical sidewall forming a generally v-shape cross-section.

11. The toothbrush of claim 10, wherein each of the contact surface sections are discontiguous from other contact surface sections and disposed at an elevation and incline or decline distinct from the other contact surfaces sections.

12. The toothbrush of claim 10, wherein the center contact surface section extends above each of the outside contact surfaces to expose a vertical side wall juxtapositioned to each of the outside contact surfaces sections to form the generally v-shaped profile therewith.

13. The toothbrush of claim 10, further comprising a user-observable second brush head orientation guide.

14. The toothbrush of claim 13, wherein the second brush head orientation guide include bristles of the inside section having a first color and bristles of the outside sections having a color distinct from the first color.

15. The toothbrush of claim 14, wherein the observable second guide includes a handle having indicators thereabout the orientation of which corresponds to the orientation of the brush head.

16. The toothbrush of claim 15, wherein the observable second guide includes a generally box shaped section of the handle having thumb rests thereon.

17. The toothbrush of claim 10, further comprising a second brush head orientation guide on the handle responsive to positioning of the brush head, the guide including a box having a thumb rest thereon for accommodating the thumb in standard grip, the thumb rest being positionable to a predetermined thumb rest orientation corresponding to a predetermined orientation of the brush head.

18. A toothbrush comprising:

an elongated handle;

a generally longitudinally extending brush head supported by the handle, the brush head having a base, a longitudinal center plane extending vertically through the base, and a plurality of bristles extending vertically from the base to form a multi-level contact surface elevated above the base and centered about the longitudinal centerplane, the plurality of bristles being arranged to form a first outside section of bristles extending vertically from the base to define a first surface section of the multi-level contact surface, a second outside section of bristles spaced laterally from the first outside section and extending vertically from the base to define a second surface section of the multi-level contact surface, and an inside section of bristles extending vertically from the base to define a center surface section of the multi-level contact surface, wherein the surface sections of the multi-level contact surface are discontigious from one another and each of the first and second surface sections is bounded by a pair of generally longitudinally extending side edges including an inside edge laterally proximate the inside section of bristles and a far side edge spaced laterally outwardly from the inside side edge, wherein the center surface section of the multi-level contact surface is positioned laterally intermediate the first and second surface sections but elevated above each inside side edge such that a vertical side wall of the inside section is exposed between each inside side edge and the center contact surface section, and wherein the inside section of bristles is positioned about the longitudinal center plane and the outside sections are spaced laterally therefrom such that one outside section is disposed on each side of the longitudinal centerplane; and a brush head orientation guide for indicating predetermined positioning of the brush head relative to a target tooth, the guide including a lateral brush head profile including a pair of generally v-shape cross sections each defined by one of the vertical side walls of the inside section and the first or second surface section adjacent the vertical side wall, the first or second surface section declining inwardly toward the vertical side wall such that the v-shaped profile has an angle that is substantially less than 90 degrees.

19. The toothbrush of claim 18, further comprising:

a second brush head orientation guide for indicating the predetermined positioning of the brush head relative to a target tooth, the second brush head orientation guide including a box-shaped lateral profile positioned about a body of the handle and alignable to an orientation corresponding to the predetermined orientation of the brush head.

20. The toothbrush of claim 18, further comprising a second brush head orientation guide for indicating the predetermined positioning of the brush head relative to a target tooth, the second bush head orientation guide including a ring positioned about the handle and having indicators thereon indicative of the orientation of the brush head.

* * * * *

UNITED STATES PATENT AND TRADEMARK OFFICE

CERTIFICATE OF CORRECTION

PATENT NO. : 8,108,962 B2
APPLICATION NO. : 12/220286
DATED : February 7, 2012
INVENTOR(S) : Davidson et al.

It is certified that error appears in the above-identified patent and that said Letters Patent is hereby corrected as shown below:

Claim 3, Column 13, line 53, delete “seconds” and insert -- second --.

Claim 11, Column 14, line 62, delete “surfaces” and insert -- surface --.

Signed and Sealed this
Twenty-seventh Day of March, 2012

David J. Kappos

David J. Kappos
*Director of the United States Patent and Trademark Office*